US008159806B2

(12) United States Patent
Cartier-Millon et al.

(10) Patent No.: US 8,159,806 B2
(45) Date of Patent: Apr. 17, 2012

(54) BISTABLE ELECTROMAGNETIC ACTUATOR, CONTROL CIRCUIT OF AN ELECTROMAGNETIC ACTUATOR WITH DOUBLE COIL AND ELECTROMAGNETIC ACTUATOR WITH DOUBLE COIL COMPRISING ONE SUCH CONTROL CIRCUIT

(75) Inventors: Christophe Cartier-Millon, Saint Martin d'Heres (FR); Gilles Cortese, Vif (FR); Cédric Bricquet, Saint Martin d'Heres (FR); Hugues Filiputti, Monestier de Clermont (FR); Michel Lauraire, Saint Maur des Fosses (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 478 days.

(21) Appl. No.: 12/527,566

(22) PCT Filed: Mar. 25, 2008

(86) PCT No.: PCT/FR2008/000397

§ 371 (c)(1), (2), (4) Date: Aug. 18, 2009

(87) PCT Pub. No.: WO2008/135670

PCT Pub. Date: Nov. 13, 2008

(65) Prior Publication Data

US 2010/0008009 A1 Jan. 14, 2010

(30) Foreign Application Priority Data

Mar. 27, 2007 (FR) ..... 07 02215
Nov. 19, 2007 (FR) ..... 07 08109

(51) Int. Cl.
*H01H 47/00* (2006.01)

(52) U.S. Cl. ..... 361/139; 361/156; 335/234

(58) Field of Classification Search ..... 361/139, 361/156; 335/234
See application file for complete search history.

(56) References Cited

U.S. PATENT DOCUMENTS

| | | | | |
|---|---|---|---|---|
| 3,403,302 | A * | 9/1968 | Mason | 361/155 |
| 6,020,567 | A | 2/2000 | Ishikawa et al. | 218/154 |
| 6,199,587 | B1 * | 3/2001 | Shlomi et al. | 137/625.5 |
| 6,262,648 | B1 | 7/2001 | Lammers | 335/229 |
| 6,373,675 | B1 | 4/2002 | Yamazaki et al. | 361/135 |
| 7,280,019 | B2 * | 10/2007 | Kolb et al. | 335/229 |
| 2002/0093408 | A1 | 7/2002 | Morita et al. | 335/220 |
| 2004/0201943 | A1 | 10/2004 | Takeuchi et al. | 361/139 |

* cited by examiner

*Primary Examiner* — Rexford N Barnie
*Assistant Examiner* — Tien Mai
(74) *Attorney, Agent, or Firm* — Steptoe & Johnson LLP

(57) ABSTRACT

A bistable electromagnetic actuator comprising a magnetic circuit comprising a magnetic yoke in which a shunt extends perpendicularly to a longitudinal axis of said yoke and comprising a permanent magnet positioned between a first surface of the yoke and the shunt. A plunger core is fitted with axial sliding between a latched position and an unlatched position. A coil extending between the shunt and a second surface of the yoke is designed to generate a first magnetic control flux to move the plunger core from an unlatched position to a latched position. A second magnetic control flux enables the plunger core to move from the latched position to the unlatched position by the action of a return spring.

15 Claims, 7 Drawing Sheets

BISTABLE ELECTROMAGNETIC ACTUATOR, CONTROL CIRCUIT OF AN ELECTROMAGNETIC ACTUATOR WITH DOUBLE COIL AND ELECTROMAGNETIC ACTUATOR WITH DOUBLE COIL COMPRISING ONE SUCH CONTROL CIRCUIT

This application is a national stage entry of International Application No. PCT/FR2008/000397, filed Mar. 25, 2008 designating the U.S., which claims the benefit of French Applications No. 0702215, filed Mar. 27, 2007, and No. 0708109, filed Nov. 19, 2007.

BACKGROUND OF THE INVENTION

The invention relates to a bistable electromagnetic actuator with magnetic latching for opening and closing commands of a vacuum cartridge of a current breaking device. The actuator comprises a magnetic circuit having a fixed magnetic yoke in which a shunt extends perpendicularly to a longitudinal axis of said yoke, the shunt being positioned in parallel manner between a first and second surface of said yoke. The actuator also comprises at least one permanent magnet with axial magnetization along the longitudinal axis of the yoke, said magnet being positioned between the first surface and the shunt. A moving plunger core is fitted with axial sliding along the longitudinal axis of the yoke between a latched position and an unlatched position. At least one coil extends axially between the shunt and the second surface, and is designed to generate a first magnetic control flux which is added to the polarization flux of said at least one permanent magnet to move the plunger core from an unlatched position to a latched position, a return spring opposing movement of said plunger core. The coil is designed to generate a second magnetic control flux opposing the polarization flux of the permanent magnet and enabling the plunger core to move from the latched position to the unlatched position by the action of said at least one return spring.

The invention relates to a control circuit for an electromagnetic actuator with a moving plunger core. The circuit comprises at least a first closing control coil designed to move the plunger core in a closing phase of the actuator. The circuit comprises at least a second opening control coil designed to move the magnetic core in an opening phase of the actuator. Said at least two control coils are coupled by mutual induction. A power supply circuit is provided for the purposes of supplying electric power to said control coils in the closing and opening phases.

The invention relates to an electromagnetic actuator comprising a magnetic circuit having a magnetic yoke, at least one permanent magnet with axial magnetization along a longitudinal axis of the yoke, and a plunger core. Said plunger core is fitted with axial sliding along the longitudinal axis between a latched position and an unlatched position.

STATE OF THE PRIOR ART

The use of bistable electromagnetic actuators with magnetic latching for opening and closing commands of a current breaking device, in particular a vacuum circuit breaker, is known and described in particular in patents (EP1012856B1, EP0867903B1, U.S. Pat. No. 6,373,675B1).

On account of the geometry of the magnetic circuit of the different known actuators, it is generally necessary to use operating coils of large size able to generate electromagnetic fields necessary for movement of the operating mechanisms.

The electric control power (number of ampere-turns) used is very large and the efficiency is low.

Furthermore, on account of the positioning of the magnet or magnets in the magnetic circuit, risks of demagnetization of said magnets can be observed. Indeed, when the magnets are placed in series in the magnetic circuit, the magnetic flux generated by the operating coil may oppose that of the magnet and in the long run lead to demagnetization of said magnets.

SUMMARY OF THE INVENTION

The object of the invention is therefore to remedy the drawbacks of the state of the technique so as to propose an electromagnetic actuator with a high energy efficiency.

The yoke of the electromagnetic actuator according to the invention comprises the second surface having an internal sleeve extending partially around the plunger core, the latter being separated from said sleeve by a radial sliding air-gap remaining uniform during movement of the plunger core in translation. In the unlatched position, the plunger core is separated from the second surface of the yoke by a third air-gap, the shunt being separated from the plunger core by a first axial air-gap.

In the latched position, the sleeve advantageously covers the plunger core over an overlap distance.

Said at least one permanent magnet is preferably separated from the shunt by a fourth air-gap.

The shunt is preferably separated radially from the yoke by a fifth air-gap.

The moving magnetic core is advantageously coupled with a non-magnetic actuating member extending along a longitudinal axis to pass through said at least one magnet and the first surface of the yoke.

In a particular embodiment, the electromagnetic actuator comprises at least one magnet having a passage hole through which the actuating member passes.

In a particular embodiment, the electromagnetic actuator comprises at least two juxtaposed magnets, said magnets being respectively cut in such a way as to leave a passage hole when they are juxtaposed.

The electromagnetic actuator advantageously comprises four magnets of identical shape.

A centring part is preferably placed in the passage hole.

The centring part is advantageously salient from said at least one magnet by the height of the fourth air-gap, said part being in contact with the shunt.

The moving core preferably comprises a frustum-shaped radial surface designed to stick against the shunt in the latched position.

The plunger core preferably comprises a hole positioned in the radial surface in contact with the third air-gap.

The hole preferably passes through the plunger core from one side of the latter to the other in a direction parallel to the longitudinal axis.

According to a development of the invention, the electromagnetic actuator comprises a first coil designed to produce the first magnetic control flux and a second coil designed to produce the second magnetic control flux.

A shock absorber is advantageously placed in the space formed by the fourth air-gap.

Advantageously, at least one intermediate element made from non-magnetic material is placed in the fifth air-gap.

The invention relates to a power supply circuit of the control circuit for an electromagnetic actuator comprising at least a first trigger capacitor connected to switching means designed to connect said at least first trigger capacitor in series with said second opening control coil. Said at least first trigger capacitor is charged by a voltage induced at the terminals of said at least second opening control coil when a closing voltage is applied to the terminals of said at least first closing control coil. The switching means are designed to connect said at least first trigger capacitor to the second opening control coil. Said at least first trigger capacitor is discharged via said second opening control coil to develop an opening voltage at the terminals of said coil during the opening phase.

Said at least first trigger capacitor preferably comprises a smaller time constant than the closing voltage application time.

The absolute value of the opening voltage is preferably equal to a charging voltage of said at least first trigger capacitor.

In a particular embodiment, the charging voltage of said at least first trigger capacitor is equal to the value of the induced voltage at the terminals of said at least second opening coil when a closing voltage is applied to the terminals of said at least first closing control coil, the absolute value of the opening voltage being equal to the absolute value of the induced voltage.

According to one embodiment of the invention, the control circuit comprises at least a second trigger capacitor. The power supply circuit comprises switching means designed to connect said at least first and second trigger capacitors in parallel during a closing phase and to connect said at least first and second trigger capacitors in series during the opening phase, the opening voltage applied to said second control coil being equal to the sum of the voltages respectively induced at the terminals of the trigger capacitors.

Said first and second trigger capacitors preferably respectively comprise smaller time constants then the closing voltage application time.

In a particular embodiment, the absolute value of the opening voltage is equal to the sum of the charging voltages of said at least first and second trigger capacitors.

The charging voltage of at least one trigger capacitor is preferably equal to the value of the voltage induced at the terminals of said at least second opening control coil when a closing voltage is applied to the terminals of said at least first closing control coil.

Advantageously, the first and second trigger capacitors are of the same value, and the absolute value of the opening voltage is equal to twice the absolute value of the induced voltage.

Said at least first closing coil preferably comprises a smaller first number of turns than a second number of turns of said at least second opening control coil so that the induced voltage at the terminals of said at least second opening control coil is greater than the closing voltage applied to said at least first closing control coil.

The switching means preferably comprise controlled switches.

The invention relates to an electromagnetic actuator comprising a magnetic circuit having a magnetic yoke, at least one permanent magnet with axial magnetization along a longitudinal axis of the yoke and a plunger core fitted with axial sliding along the longitudinal axis between a latched position and an unlatched position. The actuator comprises a control circuit as defined above, the coils extending axially along a longitudinal axis of the yoke and being designed to generate a first magnetic control flux which is added to the polarization flux of said at least one permanent magnet to move the plunger core from an unlatched position to a latched position. The action of at least one return spring opposes movement of said core. The coils are designed to generate a second magnetic control flux opposing the polarization flux of the permanent magnet and enabling movement of the plunger core from the latched position to the unlatched position by the action of said at least one return spring.

The magnetic yoke preferably comprises a shunt extending perpendicularly to a longitudinal axis of said yoke, the shunt being positioned in parallel manner between a first and second surface of said yoke, said at least one permanent magnet being positioned between the first surface and the shunt.

The coils preferably extend axially between the shunt and the second face.

According to an embodiment of the invention, the second surface of the yoke comprises an internal sleeve extending partially around the plunger core, the latter being separated from said sleeve by a radial sliding air-gap that remains uniform during movement of the plunger core in translation. In the latched position, the plunger core is separated from the second surface of the yoke by a third air-gap, a volume between the shunt and the plunger core defining a first axial air-gap.

In the latched position, the sleeve preferably covers the plunger core over an overlap distance.

Said at least one permanent magnet is preferably separated from the shunt by a fourth air-gap.

The shunt is preferably separated radially from the yoke by a fifth air-gap.

The magnetic plunger core is preferably coupled with a non-magnetic actuating member extending along a longitudinal axis to pass through said at least one magnet and the first surface of the yoke.

BRIEF DESCRIPTION OF THE DRAWINGS

Other advantages and features will become more clearly apparent from the following description of particular embodiments of the invention, given as non-restrictive examples only and represented in the accompanying drawings in which.

DETAILED DESCRIPTION OF AN EMBODIMENT

Figure 1:
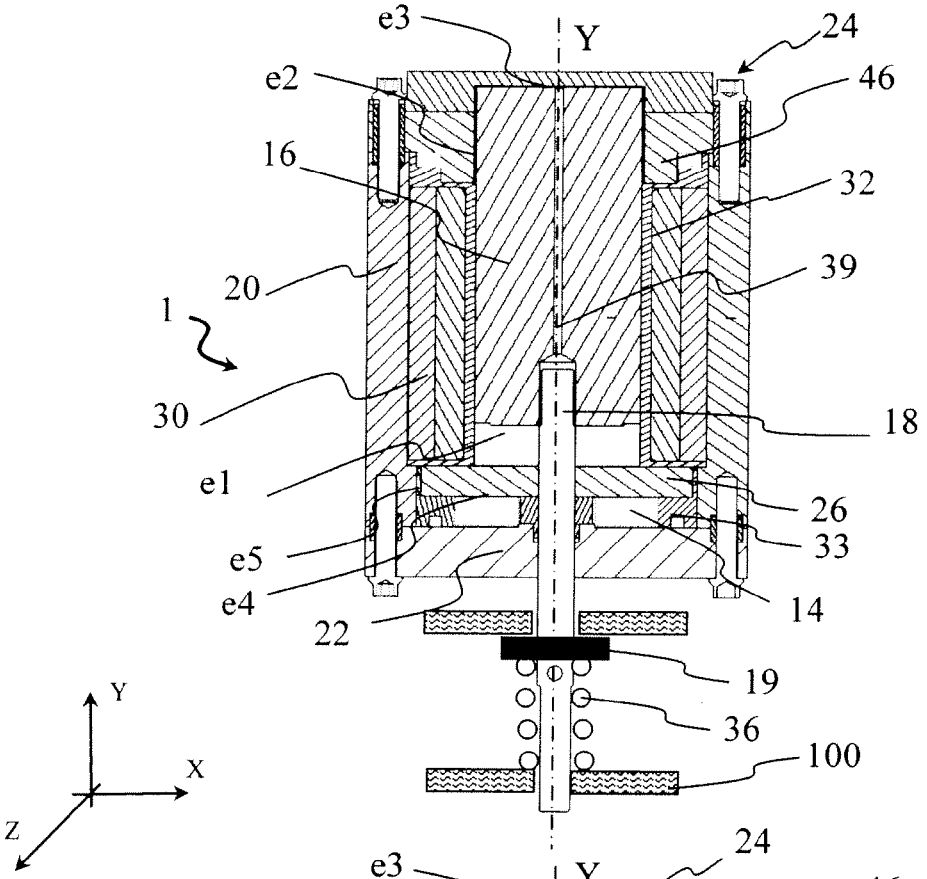
FIGS. 1 and 2 represent cross-sectional views of the electromagnetic actuator in two operating positions according to an embodiment of the invention.
Figure 2:
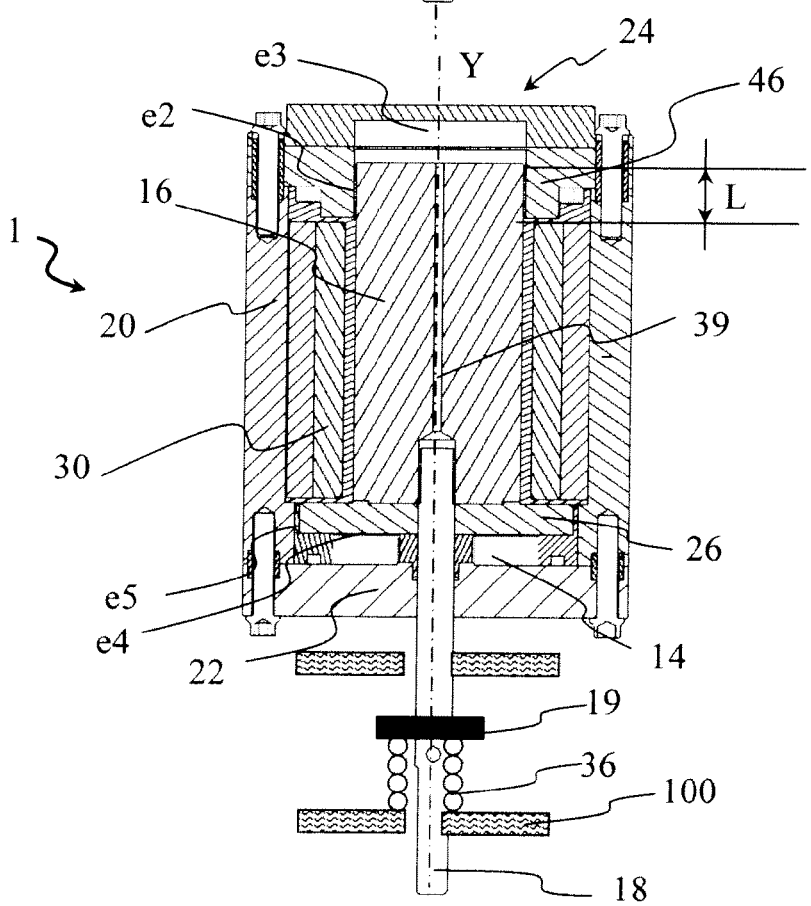

According to a first preferred embodiment presented in FIGS. 1 and 2, the bistable electromagnetic actuator with magnetic latching comprises a fixed magnetic circuit 12 made from ferromagnetic material.

Magnetic circuit 12 comprises a yoke 20 extending along a longitudinal axis Y. Yoke 20 of the magnetic circuit comprises parallel first and second surfaces 22, 24 at its opposite ends. Surfaces 22, 24 extend perpendicularly to longitudinal axis Y of yoke 20.

Figure 3:
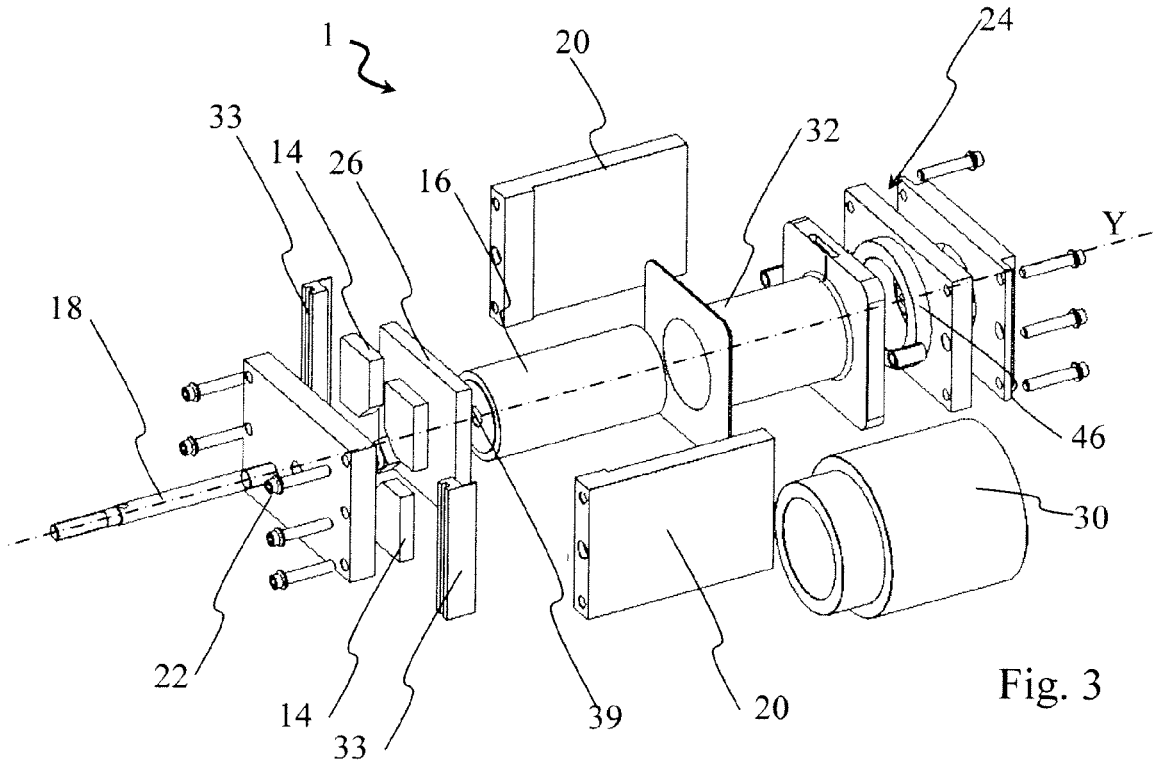
FIG. 3 represents an exploded perspective view of the electromagnetic actuator according to FIGS. 1 and 2.

Preferably, as represented in FIG. 3, yoke 20 is composed of two elongate metal walls positioned with respect to one another in such a way as to free an internal volume. The two walls are kept parallel by first and second flange-plates 22, 24 respectively placed at the ends of said walls. According to a particular embodiment, yoke 20 of parallelepipedic shape comprises at least two longitudinal surfaces open on the internal volume.

Magnetic circuit 12 further comprises a magnetic flux distribution shunt 26. The saturatable shunt 26 extends radially in a direction parallel to first flange-plate 22.

The electromagnetic actuator comprises at least one fixed control coil 30 fitted coaxially on an insulating sleeve 32 inside yoke 20. Said at least one coil 30, 30A, 30B extends axially between shunt 26 and second flange-plate 24.

Inside the internal volume of yoke 20 there is also positioned at least one permanent magnet 14 with axial magnetization. Said at least one magnet is placed between the walls of yoke 20. Permanent magnet 14 comprises two coplanar front surfaces of opposite polarities. A first surface is positioned facing shunt 26. A second surface is positioned against the inside wall of first flange-plate 22. The front surfaces are substantially perpendicular to the longitudinal axis Y of yoke 20.

The electromagnetic actuator comprises a plunger core 16 fitted with axial sliding in the direction of a longitudinal axis of yoke 20. Movement of plunger core 16 takes place inside control coil 30 between two operating positions hereinafter called latched position and unlatched position.

A first axial air-gap e1 corresponds to the gap between shunt 26 and plunger core 16. This air-gap is maximal when the plunger core is in a second operating position called unlatched position PD as represented in FIG. 1. This air-gap is zero when the plunger core is in a first operating position called latched position PA as represented in FIG. 2.

The core is preferably composed of a cylinder made of magnetic or magnetizable material. A first radial surface of the cylinder is designed to be in contact with shunt 26 when the core is in latched position PA. A second radial surface of the cylinder is designed to be positioned near the inside surface of the second flange-plate 24 when the core is in unlatched position PD.

The inside surface of second flange-plate 24 comprises an internal sleeve 46 extending partially in an annular space arranged coaxially around plunger core 16. Plunger core 16 is then separated from said sleeve 46 by a second radial sliding air-gap e2 remaining uniform during movement of plunger core 16 in translation. In the latched position, sleeve 46 preferably covers plunger core 16 over an overlap distance L. Sleeve 46 is preferably of tubular shape and made from ferromagnetic material. It can form an integral part of second flange-plate 24 or be fixed to the latter by securing means. Sliding air-gap e2 and overlap distance L between plunger core 16 and sleeve 46 are adjusted such that the reluctance of the whole of magnetic circuit 20 is as weak as possible in the internal volume of coil 30. The reluctance has to be weakest over the whole travel of plunger core 16 between the two operating positions.

Plunger core 16 in unlatched position PD is separated from the inside wall of second flange-plate 24 by a third axial air-gap e3 corresponding to the gap between second flange-plate 24 and plunger core 16. This air-gap e3 is minimum when the plunger core is in unlatched position PD as represented in FIG. 1.

When the core is in latched position PA, the latter is kept sticking against shunt 26 by a magnetic attraction force FA due to a polarization flux $\phi U$ generated by said at least one permanent magnet 14. Plunger core 16 is designed to be biased to unlatched position PD by at least one return spring 36. Return force FR of return spring 36 tends to oppose magnetic attraction force FA generated by permanent magnet 14. In latched position PA, the intensity of magnetic attraction force FA is greater than the opposing return force exerted by said at least one return spring 36.

According to an alternative embodiment of the invention, plunger core 16 comprises a frustum-shaped radial surface designed to stick against shunt 26 in the latched position.

First front surface of said at least one permanent magnet 14 is separated from shunt 26 by a fourth air-gap e4. Said air-gap e4 is dimensioned such as to be as small as possible so as not to reduce the efficiency of magnet 14 but to be sufficient to prevent any mechanical shocks on the magnet or magnets. A shock absorber can be placed in the space formed by fourth air-gap e4. This shock absorber can comprise a gel. The object of this shock absorber is to reduce any repercussion of the shock between plunger core 16 and shunt 26 when said core moves from its unlatched position PD to its latched position PA.

According to a particular embodiment, shunt 26 extending radially in a direction parallel to first flange-plate 22 26 is separated from yoke 20 by a fifth air-gap e5. At least one intermediate element 33 made from non-magnetic material can be placed in fifth air-gap e5. This intermediate element acting in particular as support for shunt 26 guarantees that fifth air-gap e5 is maintained. Shunt 26 can comprise a variable cross-section. Modifying the size of fifth air-gap e5 and/or the cross-section of shunt 26 enables the reluctance value of said shunt to be adjusted.

Magnetic plunger core 16 is coupled to a non-magnetic actuating member 18 passing axially though an opening 17 made in first flange-plate 22. Non-magnetic actuating member 18 also passes through said at least one magnet 16. Magnetic core 16 and actuating member 18 form the moving assembly of actuator 1.

Figure 4:
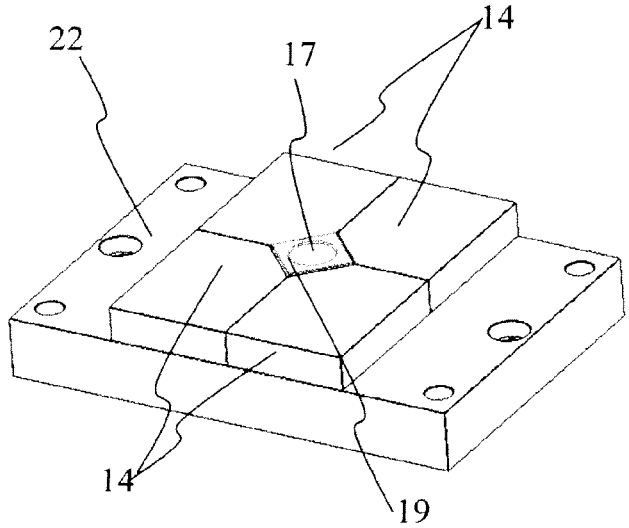
FIG. 4 represents a detailed perspective view of the electromagnetic actuator according to FIGS. 1 and 2.

According to one embodiment of the invention, for ease of producing said at least one magnet 16, electromagnetic actuator 1 comprises at least two juxtaposed magnets 16. Said permanent magnets are respectively cut so as to leave passage hole 17 when they are juxtaposed. A centring part 19 is preferably placed in passage hole 17. Centring part 19 is salient from said at least one magnet 16 by the height of fourth air-gap e4. Said part is then in contact with shunt 26. Centring part 19 serves the purpose both of positioning the magnets, of absorbing a part of the mechanical shocks when plunger core 16 comes into contact with shunt 26 and finally also plays a part in guiding moving assembly 16, 18. According to an alternative embodiment as represented in FIG. 4, the electromagnetic actuator comprises four magnets 16 of identical shape.

According to a particular embodiment, the moving assembly of electromagnetic actuator 1 is designed to control a vacuum cartridge of a current breaking device.

According to one embodiment of the invention as represented in FIGS. 1 and 2, the return spring is positioned outside yoke 20. It comprises a first bearing surface on a first external support such as a frame 100 and comprises a second bearing surface on a stop 19 placed on actuating member 18. In the unlatched position PD, said stop 19 is pressing on a second external support. For example purposes, the second external support can in particular form part of the external surface of first flange-plate 22. This longitudinal positioning of stop 19 on actuating member 18 enables the length of movement of the moving assembly of actuator 1, and more particularly the length of third air-gap e3 in unlatched position PD, to be controlled. Movement of stop 19 along actuating member 18 does in fact enable the minimum size of this third air-gap e3 to be adjusted. Securing in latched position PA is guaranteed by said at least one return spring 36, 37.

Said at least one coil 30 is designed to generate a first magnetic control flux ϕC1 in magnetic circuit 12. First magnetic control flux ϕC1 is designed to be added to polarization flux ϕU of permanent magnet 14. First magnetic control flux ϕC1 thus tends to oppose the action of said at least one return spring 36, 37 so as to move plunger core 16 from its unlatched position PD to its latched position PA. Said at least one coil 30 is designed to generate a second magnetic control flux ϕC2 in magnetic circuit 12, which flux opposes polarization flux ϕU of permanent magnet 14 so as to release plunger core 16 and to enable movement of the latter from latched position PA to unlatched position PD. Movement of plunger core 16 from latched position PA to unlatched position PD takes place by the action of said at least one return spring 36, 37.

Electromagnetic actuator 1 preferably comprises a first coil 30A optimized to produce first magnetic control flux ϕC1 and a second coil 30B optimized to produce second magnetic control flux ϕC2.

Figure 7:
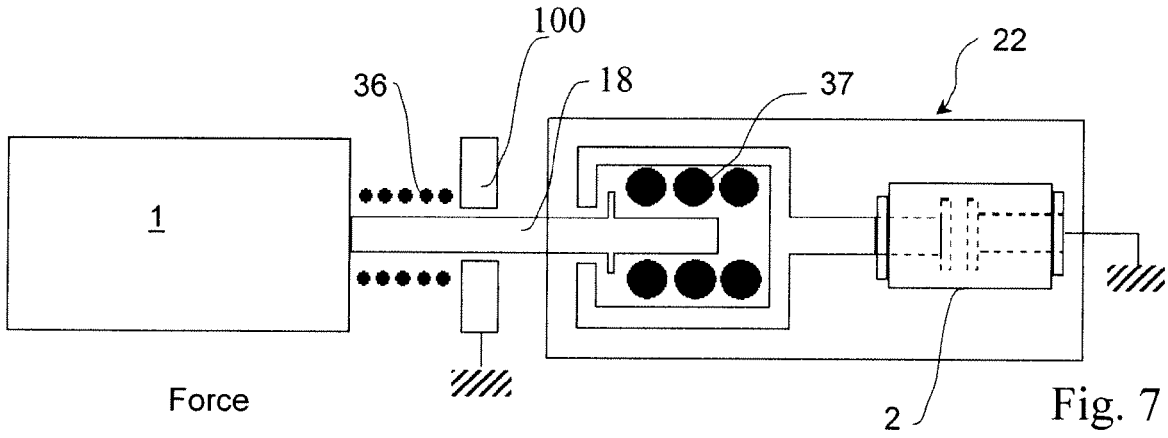
FIG. 7 represents a block diagram of the electromagnetic actuator coupled with a current breaking device.

According to one embodiment of the invention as represented in FIG. 7, electromagnetic actuator 1 can be designed to control a current breaking device 22 in particular comprising a vacuum cartridge 2. First coil 30A generating first control flux ϕC1 is then designed to close the contacts of the vacuum cartridge. Furthermore, second coil 30B generating second magnetic control flux ϕC2 is then designed for opening the contacts of vacuum cartridge 2. First coil 30A is then called closing coil and second coil 30B is called opening coil.

Due to the geometric configuration of magnetic circuit 12 and in particular due to the positioning of magnetic shunt 26 with respect to coil 30 and of said at least one magnet 16, the flux created by coils 30, 30A, 30B never flows through said at least one magnet. The risk of demagnetization of magnet 14 is thereby limited.

Figure 5A:
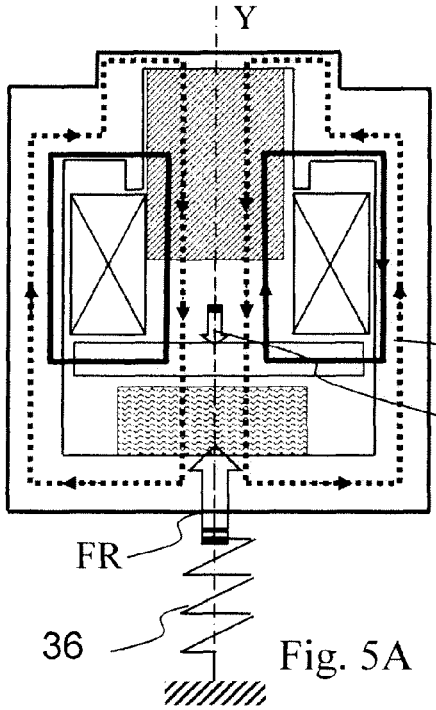
FIGS. 5A, 5B, 5C and 5D represent diagrams of the electromagnetic actuator in the course of actuation from the unlatched position to the latched position.
Figure 5B:
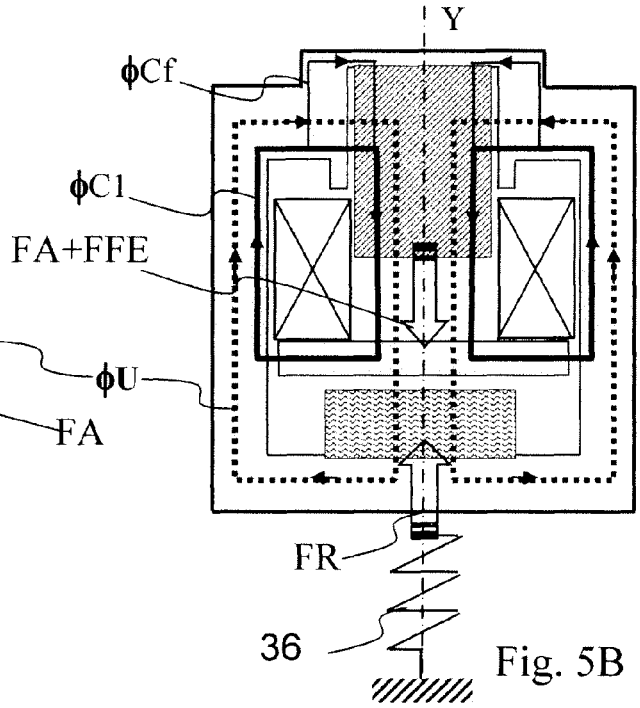
Figure 5C:
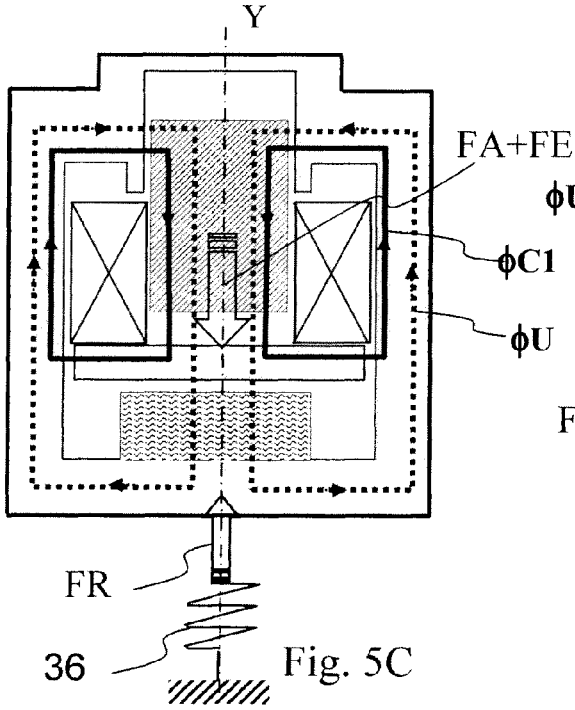
Figure 8:
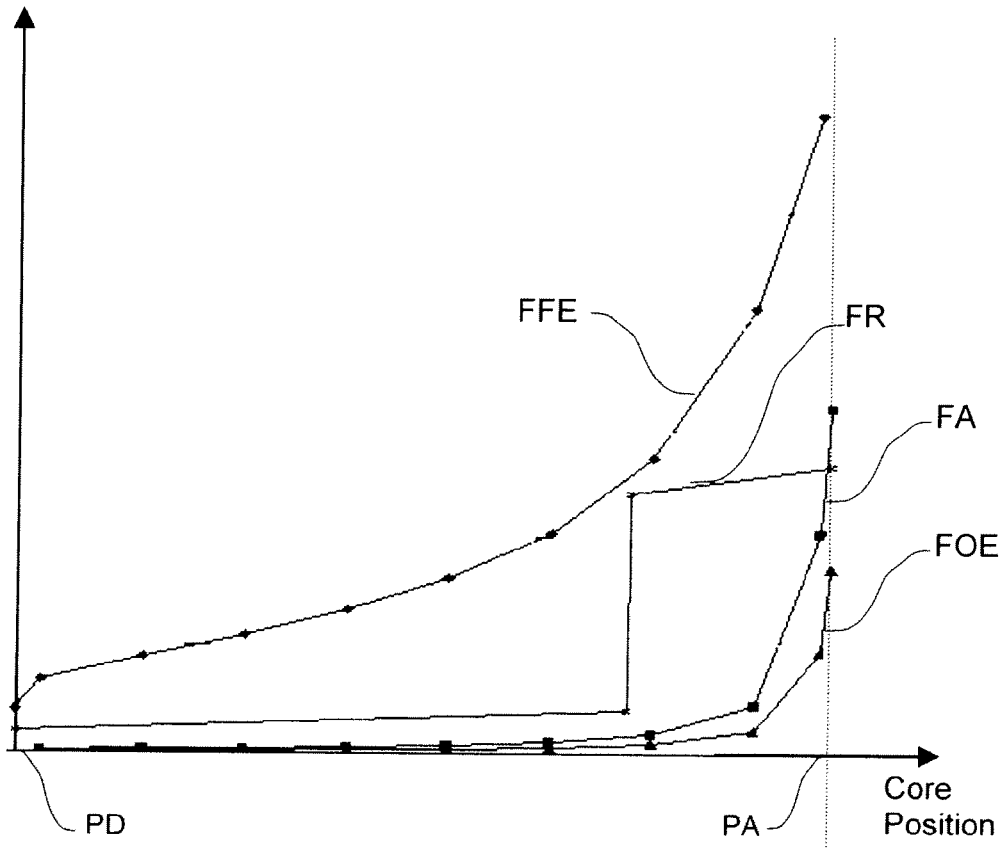
FIG. 8 represents curve plots of the intensity of the forces generated by the electromagnetic actuator.

To move from an open position to a closed position of the contacts of vacuum cartridge 2, operation of electromagnetic actuating device 1 is as follows. As represented in FIG. 5A, two opposing forces are applied to plunger core 16. A return force FR applied by return spring 36 on plunger core 16 by means of a non-magnetic actuating member 18 tends to hold plunger core 16 in an unlatched position, the contacts being in the open position. Return force FR opposes a first magnetic closing force FA due to polarization flux ϕU of magnet 14. Magnetic closing force FA is of greater intensity than return force FR. As represented in FIG. 5B, first coil 30A is supplied with power to close the contacts. First coil 30A generates first control flux ϕC1. First control flux ϕC1 flows in the same direction as polarization flux ϕU of magnet 14. The first flux produces an electromagnetic closing force FFE. The two closing forces FA, FFE are added together and tend to move plunger core 16 from its unlatched position PD to its latched position PA. The intensity of electromagnetic closing force FFE undergoes a variation of exponential type as represented in FIG. 8. This variation depends directly on the geometry of the coil, in particular on its inductance and on the type of electric power supply used.

According to one embodiment of the invention, when plunger core 16 moves away from its unlatched position, the intensity of electromagnetic closing force FFE is greater than that of return force FR of return spring 36. This non-zero intensity (offset) of electromagnetic closing force FFE at the beginning of movement of plunger core 16 will enable an electromagnetic closing force FFE that is always greater than return force FR to be obtained in the course of movement of the plunger core.

The offset value is linked to the size of third air-gap e3, to magnet 14 and to first control flux ϕC1. As represented in FIG. 5B, second flange-plate 24 diverts a part of first control flux ϕC1 from the main magnetic circuit. This diverted flux ϕCd creates an antagonistic force temporarily opposing electromagnetic closing force FFE. The time necessary to establish an efficient electromagnetic closing force FFE for movement of the plunger core is then longer. The dynamic beginning of movement of plunger core 16 is then delayed. This delay enables the electric current flowing in first coil 30A to reach a sufficient intensity to generate an efficient first control flux ϕC1.

As represented in FIG. 8, when plunger core 16 starts to move, the potential energy stored by the electromagnetic actuator is then sufficient to guarantee an electromagnetic closing force FFE that will always be of greater intensity than return forces FR. This guarantees closing without any downtime and without plunger core 16 being slowed down.

Figure 5D:
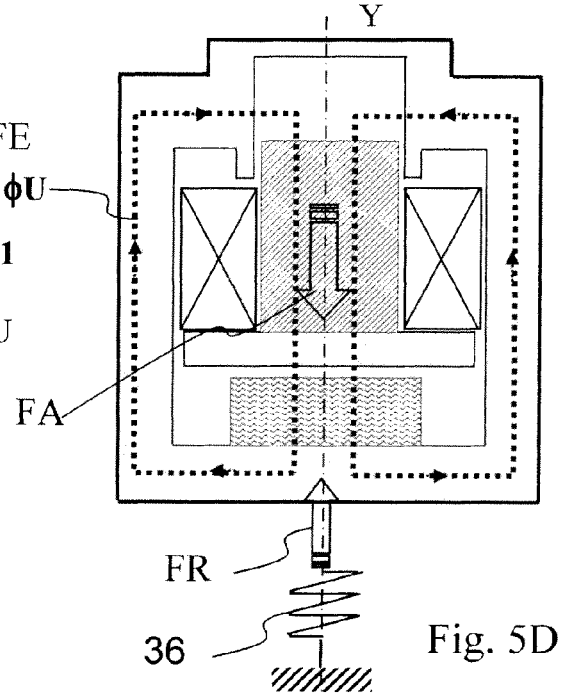
Figure 9:
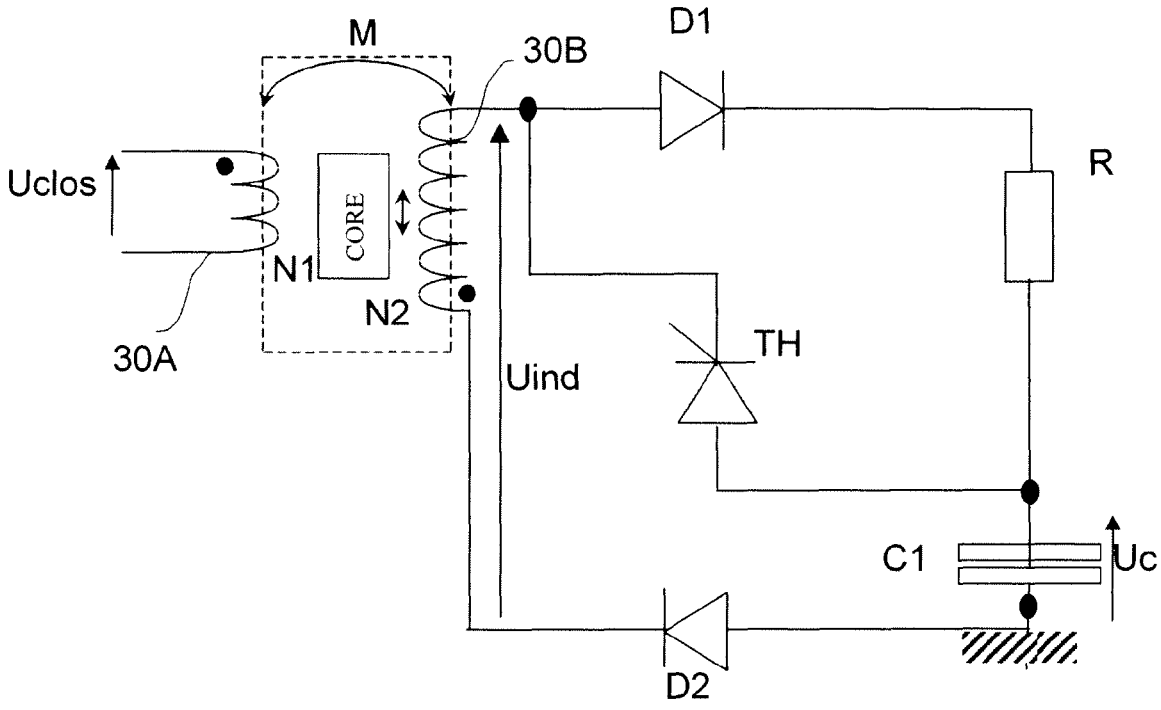
FIG. 9 represents a wiring diagram of a control circuit according to a first preferred embodiment of the invention.

According to a particular embodiment of the invention as represented in FIG. 9, during movement of plunger core 16 from its unlatched position PD to its latched position PA, electromagnetic closing force FFE will oppose a second force generated by a second return spring 37. This second spring 37 is designed to apply a contact pressure force in particular to keep the electric contacts of vacuum cartridge 2 closed. This second spring 37 will be compressed by the action of electromagnetic closing force FFE. As represented in FIG. 8, it is at about two thirds of the closing travel of plunger core 16 that the combined return forces of first and second return springs 36, 37 will oppose electromagnetic closing force FFE. When plunger core 16 is in the latched position PA as represented in FIG. 5D, the power supply to the closing coil is interrupted. As represented in FIG. 8, first magnetic closing force FA is then of greater intensity than the sum of return forces FR developed by first and second springs 36, 37. This magnetic latching of plunger core 16 in latched position PA can also be combined with mechanical latching.

Figure 6A:
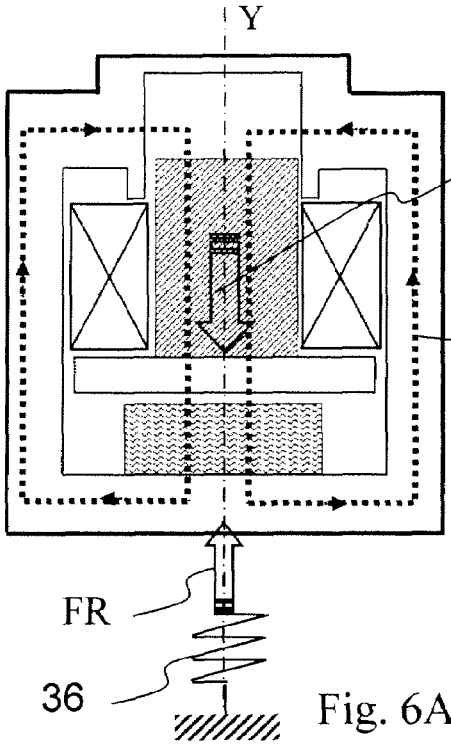
FIGS. 6A, 6B, 6C and 6D represent diagrams of the electromagnetic actuator in the course of actuation from the latched position to the unlatched position.

To move from a closed position to an open position of the contacts of the vacuum cartridge 2, in other words from latched position PA to unlatched position PD of plunger core 16, operation of electromagnetic actuating device 1 is as follows. As represented in FIG. 6A, two opposing forces are applied on plunger core 16; a magnetic force FA due to polarization flux ϕU of magnet 14 and a return force FR resulting from the forces applied by said at least one return spring 36, 37. The magnetic force FA is then of greater intensity than the return force FR.

According to the embodiment represented in FIG. 7, return force FR results from the sum of the forces applied jointly by the first and second return springs 36, 37.

Figure 6B:
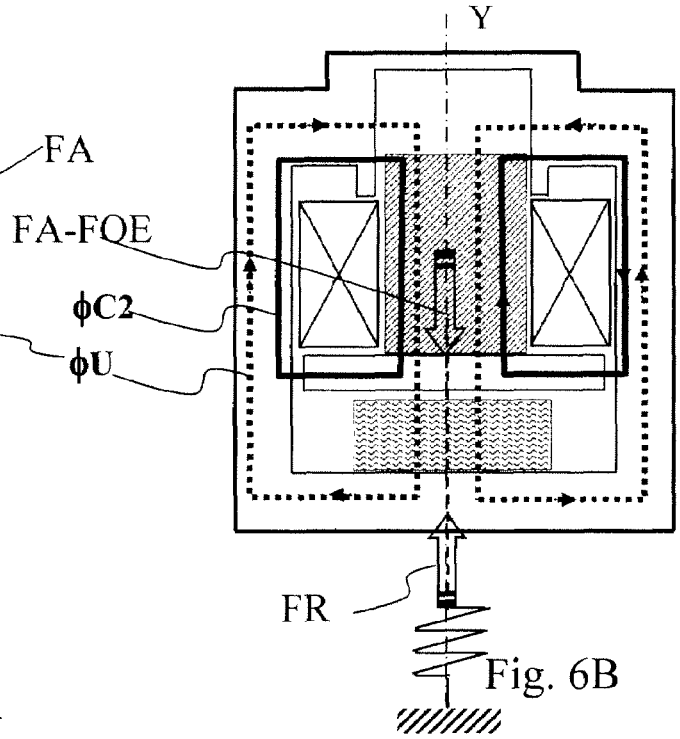

As represented in FIG. 6B, second coil 30B is supplied with power to generate second control flux ϕC2. Second control flux ϕC2 flows in an opposite direction to polarization flux ϕU of magnet 14. Second control flux ϕC2 produces an electromagnetic opening force FOE. Return force FR and electromagnetic opening force FOE are added together and the resulting opening force is then of greater intensity than the magnetic latching force FA and tends to move plunger core 16 from its latched position PA to its unlatched position PD.

According to an alternative embodiment, plunger core 16 comprises a hole 39 positioned in the radial surface in contact with third air-gap e3. This hole 39 passes right through said core in the direction of its longitudinal axis. When the plunger core moves from latched position PA to unlatched position PD, hole 39 enables the air contained in the volume of third air-gap e3 to be removed. The air can be removed instead of being compressed which enables an effect called piston effect to be avoided. This piston effect would give rise to a compression force opposing movement of plunger core 16.

The two coils 30A, 30B can be supplied with electric power in independent manner. For example, first closing coil 30A operates in 250 Volts DC with a current of 10 A, whereas second opening coil 30B requires several hundred volts with 40 mA. The diameter of the wire of the two coils 30A, 30B is different. Said coils in addition comprise a different number of turns.

According to an alternative embodiment of the invention, the first and second coils can be connected in series on opening. Second opening coil 30B will be short-circuited on closing.

First closing coil 30A requires a large amount of energy for a given time to close the actuator. The supply time of first coil 30A is for example equal to about 150 ms. This power is provided by the electric power supply system.

According to an alternative embodiment of the invention, electric power supply of first coil 30A can be performed by means of an amplitude modulated current pulse. This management of the intensity of the electric current flowing in first coil 30A enables the speed at which plunger core 16 moves from unlatched position PD to latched position PA to be controlled. Reducing the speed of plunger core 16 when it comes into contact with the shunt can in particular present an interest. Reducing the force of impact between the plunger core and the shunt reduces the mechanical stresses stored by the magnetic circuit.

In the opposite way, second coil 30B only requires a very small amount of energy to open the actuator. This energy can come from a capacitor C1 of low capacitance. For example, the capacitance value will in particular be about ten Microfarads with a service voltage able to reach several thousand volts. The service voltage can for example be equal to 1000Vdc.

This capacitor C1 should preferably be of the film type, in particular polypropylene film. Unlike chemical capacitors whose electrolyte dries out, this type of capacitor C1 comprising a polypropylene film has an excellent lifetime. This type of component does not require any replacement throughout the whole lifetime of the electromagnetic actuator. This capacitor C1, via second coil 30B, acts on opening in the event of a short-circuit. In addition, its reliability guarantees a good level of operating safety of the electromagnetic actuator. On account of the capacitive value of the capacitor, the latter can recharge in a few milliseconds, which is particularly advantageous for circuit breakers with high-speed cycles intended for Medium-Voltage protection functions. These circuit breakers generally used for the overhead power grid are commonly called Recloser circuit breakers. The use of this capacitor C1 presents an interest when the circuit breaker is used for successive high-speed opening and closing O-C-O-C cycles. This capacitor C1 can be recharged continuously by the power system or by current transformers. Photovoltaic cells can also be used when the appliance is located on the top of posts.

Furthermore, as represented in FIG. 9, an electromagnetic coupling is present between the two control coils 30A, 30B. On account of this coupling, capacitor C can be recharged by the voltage Uind recovered at the terminals of second opening coil 30B when a voltage Uclos is applied to first closing coil 30A. In case of a mains supply failure after closing of electromagnetic actuator 1 associated with a Recloser circuit breaker, capacitor C1 having been recharged by the energy induced in opening coil 30B, opening is possible immediately without any additional power having to be supplied. As represented in FIG. 9, a switch TH in particular comprising a thyristor or a transistor can be used to connect capacitor C1 to second opening coil 30B. Said recovered voltage Uind being high due to the high ratio of the number of turns of the second coil, the capacitor would be used as storage but also as means for clipping any induced voltage.

The invention relates to a control circuit for an electromagnetic actuator with plunger core 16. The circuit comprises at least a first closing control coil 30A designed to move plunger core 16 in a closing phase of the actuator and at least a second opening control coil 30B designed to move plunger core 16 in an opening phase of the actuator. Said at least first closing control coil 30A comprises a first number of turns N1. Said at least second opening control coil 30B comprises a second number of turns N2. Said at least two control coils 30A, 30B are coupled by mutual induction M. Said at least first coil constitutes the primary circuit of a transformer and said at least second coil constitutes the secondary circuit. The magnetic circuit of the transformer in particular comprises plunger core 16.

According to a particular embodiment, the control circuit comprises two control coils 30A, 30B. Advantageously, the first number of turns N1 is smaller than the second number of turns N2. The two control coils 30A, 30B then constitute a step-up transformer (N2>N1).

Control coils 30A, 30B are designed to generate a first magnetic control flux ϕC1 in the closing phase and a second magnetic control flux ϕC2 in the opening phase. In a closing phase, first closing control coil 30A is supplied by a closing voltage Uclos to generate first magnetic control flux ϕC1. In an opening phase, second opening control coil 30B is supplied by an opening voltage Uopen to generate second magnetic control flux ϕC2. Opening voltage Uopen is then of opposite sign to closing voltage Uclos.

According to an embodiment example presented in FIGS. 1 and 2, said at least two control coils 30A, 30B are contained in a magnetic yoke 20 having a longitudinal axis Y. Plunger core 16 is fitted with axial sliding along the longitudinal axis Y between a latched position and an unlatched position. The coils are preferably concentric and extend axially in the direction of the longitudinal axis Y of yoke 20. Electromagnetic coupling between control coils 30A, 30B is performed by means of plunger core 16 and the magnetic yoke of the actuator.

The control circuit further comprises a power supply circuit designed to supply power to said control coils 30A, 30B in the closing and opening phases of the electromagnetic actuator.

According to a preferred first embodiment of the invention as represented in FIG. 9, the power supply circuit comprises means for placing at least a first trigger capacitor C1 in series with said second opening control coil 30B.

According to this embodiment, the electric control circuit for closing the actuator generates a closing voltage Uclos modulated in amplitude. This modulation is of PWM type. Modulation of the control signal with a period T comprises a duty ratio $\alpha$ varying from 0 to 100%. A chopped current corresponding to closing current Iclos flows in said first closing control coil 30A. If the modulation duty ratio $\alpha$ is equal to 100 ($\alpha$=100%), a signal having the shape of a uniform pulse is obtained.

This control of the intensity of the electric current flowing in the first closing control coil 30A can enable the dynamics of the plunger core 16 in the closing phase to be controlled.

According to a particular embodiment, the closing voltage is modulated in amplitude with a duty ratio of about 90%.

In this particular embodiment of the invention, the electric control circuit is supplied by an AC voltage of an electric power supply system. Means rectify the AC voltage into DC voltage. The DC voltage supplies electronic control means delivering the amplitude-modulated closing voltage Uclos.

Power supply of said first closing control coil 30A is managed in such a way that the closing current curve follows conventional laws of physics of closing of an electromagnetic contactor.

When a closing voltage Uclos is applied to the terminals of said at least first closing control coil 30A, a voltage Uind is induced at the terminals of said second opening control coil 30B. Induced voltage Uind generated on the secondary is proportional to closing voltage Uclos. The ratio between induced voltage Uind and closing voltage Uclos depends on the transformation ratio of the second number of turns N2 of second opening control coil 30B over the first number of turns N1 of first closing control coil 30A. This voltage step-up transformation ratio can be written in the form of the following equation:

$$\left(Uind = Uclos.\frac{N2}{N1}\right)$$

Figure 11:
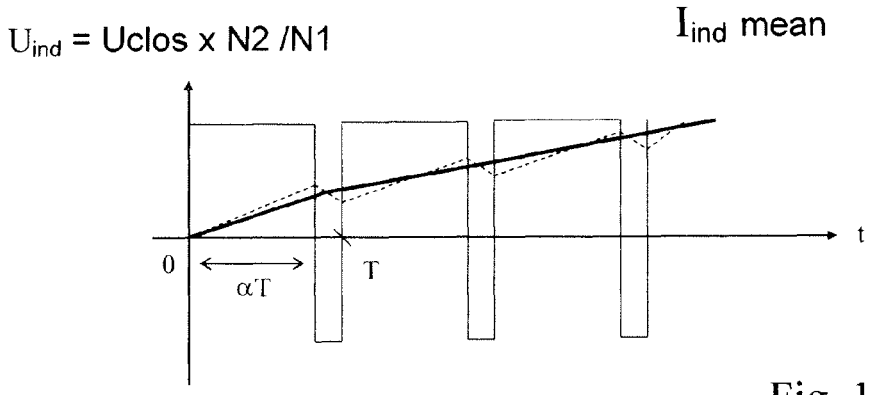
FIG. 11 represents a plot of the induced voltage at the terminals of an opening coil versus the closing voltage applied to the closing coil.

The step-up transformation ratio also depends on the variations generated by the closing dynamics of plunger core 16 of the actuator which makes the magnetic flux vary. As represented in FIG. 11, induced voltage Uind has a zero mean value.

The control power supply circuit comprises switching means D1, D2, TH to connect said at least first trigger capacitor C1 in series with said second opening control coil 30B.

Figure 13:
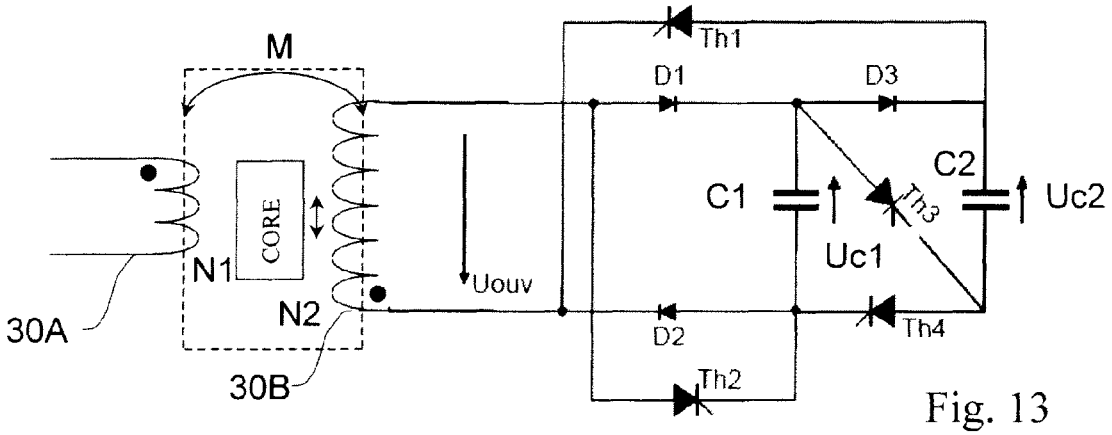
FIG. 13 represents a wiring diagram of a control circuit according to a second preferred embodiment of the invention.

According to a particular embodiment of the invention as represented in FIG. 13, the switching means comprise two rectifying diodes D1, D2 and a controlled switch TH such as in particular a thyristor or a transistor.

Figure 12:
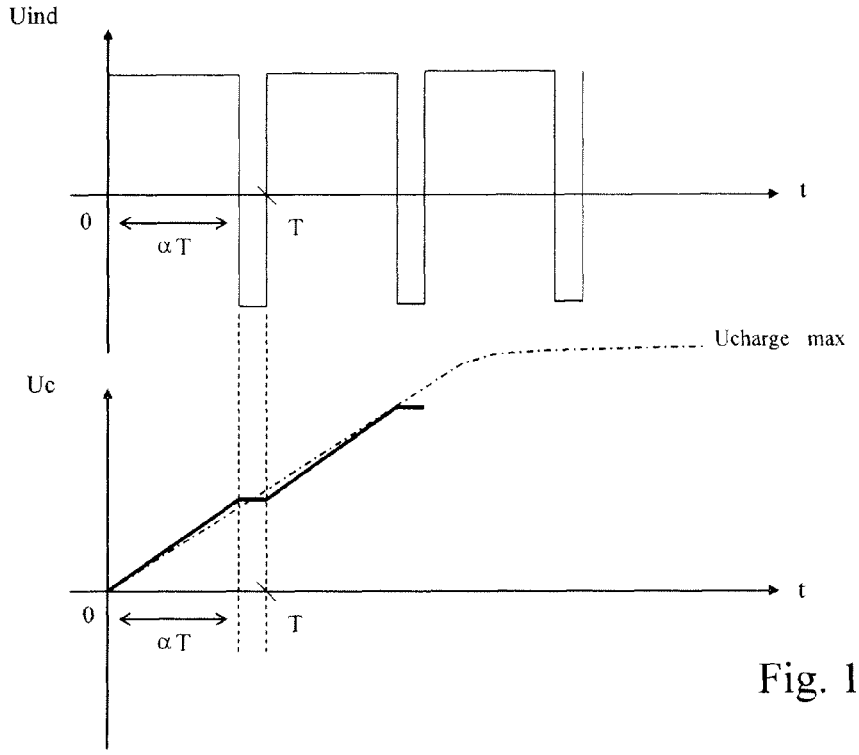
FIG. 12 represents a plot of the charging profile of a trigger capacitor of a control circuit according to FIG. 9.

Said at least first trigger capacitor C1 is charged by induced voltage Uind at the terminals of said at least second opening coil 30B when a closing voltage Uclos is applied to the terminals of said at least first closing control coil 30A. Charging of said at least one trigger capacitor C1 is performed via the two rectifying diodes D1, D2. According to this particular embodiment, only the positive half-waves of induced voltage Uind are used to charge said at least one trigger capacitor C1. According to another embodiment, not represented, it can be envisaged to rectify the induced voltage for charging said at least one capacitor. As represented in FIG. 12, the charging profile of trigger capacitor C1 follows a normal electric capacitor exponential charging law. Charging voltage Uc is then equal to:

$$Uc = Uind.(1 - e^{-\frac{t}{\tau}})$$

t being equal to time and $\tau$ being the time constant of the capacitor.

At the moment opening takes place, the energy stored in said at least trigger capacitors C1 can be discharged in second opening control coil 30B. It is therefore not necessary to have an auxiliary power source in the opening phase. Opening voltage Uopen applied to said second opening control coil 30B is delivered by said at least one trigger capacitor C1. The absolute value of the opening voltage Uopen is equal to the charging voltage Uc of said at least first trigger capacitor C1.

Charging voltage Uc preferably has to reach the induced voltage value Uind within the time during which closing voltage Uclos is applied to the terminals of closing coil 30A. The trigger capacitors are selected in particular so as to have a time constant $\tau$ that is as small as possible compared with the application time of closing voltage Uclos.

According to an embodiment of the invention, charging voltage Uc of said at least first trigger capacitor C1 is equal to the value of induced voltage Uind at the terminals of said at least second opening coil 30B. The absolute value of opening voltage Uopen is then equal to the absolute value of induced voltage Uind.

Opening voltage Uopen must be of opposite direction to closing voltage Uclos to move plunger core 16 in the opening phase of the actuator. Controlled switch TH of the switching means enables the voltage at the terminals of said at least one trigger capacitor C1 to be reversed.

Figure 10:
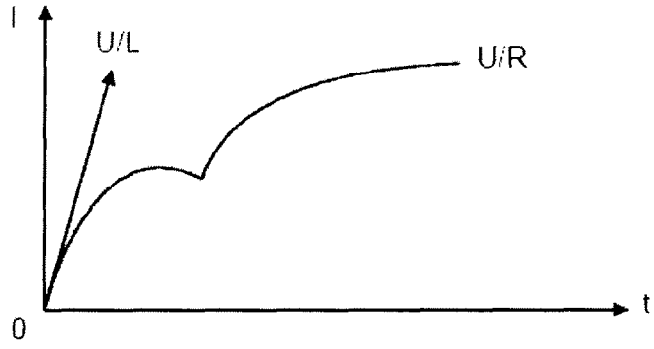
FIG. 10 represents a curve plot representative of the progression of the value of the electric current I versus the voltage U applied to the terminals of a coil of a control circuit according to FIG. 9.

It is known that the dynamics of an electromagnetic actuator with a plunger core are the image of the electric current flowing in the coil used for movement of the core. A curve representative of the progression of the value of electric current I versus the voltage U applied at the terminals of said coil is represented in FIG. 10. The slope of the curve at the origin representative of the acceleration of the core depends on the ratio between the voltage U and inductance L of the coil. The inductance L of the coil being a parameter that is intrinsic to the system, increasing the voltage U is the only way to reduce the reaction time of the electromagnetic actuator. The higher the voltage value for a given coil, the sharper the curve will be and the greater the initial acceleration of the plunger core.

To increase opening voltage Uopen, it would be recommended to increase step-up transformation ratio N1/N2. However, it is not possible to increase the number of coil turns, in particular of second opening control coil 30B. The maximum size of control coils 30A, 30B is in fact determined by the volume of the actuator and in particular by the internal volume of the magnetic yoke. Furthermore, the solution consisting in reducing the cross-section of the wire to increase the number of turns without changing the winding volume is also not acceptable. Reducing the cross-section of the winding wire would in fact be accompanied by an increase of the resistance and inductance of the coil. These changes would have detrimental effects on the charging and discharging time of trigger capacitors C1, C2. A slowing-down of charging of the capacitors would be observed as would an increase of the discharging time. This result is incompatible with the performances required from the actuator in particular on opening where speed of actuation is sought for.

According to a second preferred embodiment of the invention, to increase the opening voltage Uopen to command second opening control coil 30B, the control circuit comprises at least a second trigger capacitor C2.

In a particular embodiment of the second preferred embodiment as represented in FIG. 13, the control circuit comprises two trigger capacitors C1, C2.

At the moment the closing phase takes place, the power supply circuit comprises switching means TH1, TH2, TH3, TH4, D1, D2, D3 to connect said at least first and second trigger capacitors C1, C2 in parallel with said second opening control coil 30B.

According to the particular embodiment of the invention as represented in FIG. 13, the switching means comprise three diodes D1, D2, D3 and four controlled switches TH1, TH2, TH3, TH4 such as in particular thyristors or transistors.

When a closing voltage Uclos is applied to the terminals of said at least first closing control coil 30A, a voltage Uind is induced at the terminals of said second opening control coil 30B. Trigger capacitors C1, C2 are thus charged by an induced voltage Uind at the terminals of second opening control coil 30B.

Charging of trigger capacitors C1, C2 in parallel is performed via first and second diodes D1, D3 for positive polarities and by a controlled switch Th4 and a third diode D2 for negative polarities. Said controlled switch Th4 is controlled at the same time as closing of the actuator to enable parallel connection. According to this particular embodiment, only the positive half-waves of induced voltage Uind are used to charge trigger capacitors C1, C2. According to another embodiment, not represented, it can be envisaged to rectify the induced voltage, in particular by using a diode bridge for charging said at least one capacitor.

At the time the opening phase of the actuator takes place, the power supply circuit comprises switching means TH1, TH2, TH3, TH4, D1, D2, D3 to connect trigger capacitors C1, C2 in series with said second opening control coil 30B.

The absolute value of the opening voltage Uopen is equal to the sum of the charging voltages Uc1, Uc2 of said at least first and second trigger capacitors C1, C2.

According to an embodiment of the invention, charging voltage Uc1, Uc2 of at least one trigger capacitor C1, C2 is equal to the value of induced voltage Uind at the terminals of said at least second opening control coil 30B when a closing voltage Uclos is applied to the terminals of said at least first closing control coil 30A.

Said first and second trigger capacitors C1, C2 preferably respectively comprise smaller time constants $\tau$ than the application time of closing voltage Uclos.

First and second trigger capacitors C1, C2 are preferably of the same value, and the absolute value of opening voltage Uopen is equal to twice the absolute value of induced voltage Uind. Discharging of series-connected trigger capacitors C1, C2 thereby enables opening voltage Uopen to be doubled.

Opening voltage Uopen has to be of opposite direction to closing voltage Uclos in order to move plunger core 16 in the opening phase of the actuator. Switching means Th1, Th2, Th3, Th4 enable charging voltages Uc1, Uc2 at the terminals of trigger capacitors C1, C2 to be reversed.

Parallel discharging is performed by a first controlled switch Th1 for positive polarities and by a second controlled switch Th2 for negative polarities. A third controlled switch Th3 performs series connection of the two capacitors.

Depending on the embodiment used, charging two trigger capacitors C1, C2 in parallel instead of only one makes the charging voltage drop by 25%. Furthermore, discharging two trigger capacitors C1, C2 in series increases the voltage by 60%. This increase of the opening voltage according to the embodiment used enables the required speed performances to be obtained on opening.

The 25% drop is due to the fact that the transformer formed by the two control coils 30A, 30B is not a perfect generator. It has an impedance due to the resistance of the wires and to the inductance of the coils. This impedance limits the current supplied by opening control coil 30B which charges the capacitors.

The value of trigger capacitors C1, C2 is optimized according to the required opening speed and to the coils dimensioned for a given volume.

According to a variant of the preferred embodiments of the control circuit, the electronic control means of the control circuit comprise means for recharging trigger capacitors C1, C2 when the actuator has been closed. Trigger capacitors C1, C2 are recharged periodically with a frequency that is variable according to the technologies used in order to compensate losses by self-discharging. The electronic means then send pulses of short duration into first closing control coil 30A. The value of the recharging time of the capacitors depends on the intrinsic values of the components. Trigger capacitors C1, C2 are therefore recharged by several control cycles Uclos. According to a particular embodiment, the recharging pulses have a duration of about a few tens of milliseconds and the recharging periodicity is greater than ¼ hour and may be much longer according to the capacitor technology involved.

As the energy required for opening is small, trigger capacitors C1, C2 present a low capacitance value. For example, the capacitance values should in particular be about ten Microfarads, the capacitors having a service voltage which can reach several thousand volts. For example, the service voltage can be equal to 1000Vdc. Due to the low capacitive value of trigger capacitors C1, C2, the latter can recharge in a few milliseconds, which is particularly interesting for circuit breakers with high-speed cycles designed for Medium-Voltage protection.

They are further preferably designed with a polypropylene film type technology and comprise a good lifetime at least equal to that of the actuator. Its reliability guarantees the electromagnetic actuator a good level of operating safety.

According to a variant of the different embodiments of the invention, the power necessary for the control electronics of the switching means, in particular of controlled switches TH, TH1, TH2, TH3, TH4, is tapped from at least one trigger capacitor C1, C2.

The invention also relates to a bistable electromagnetic actuator with magnetic latching comprising a fixed magnetic circuit 12 made from ferromagnetic material. According to a first preferred embodiment presented in FIGS. 1, 2, 3, magnetic circuit 12 comprises a yoke 20 extending along a longitudinal axis Y. Yoke 20 of the magnetic circuit comprises first and second parallel surfaces 22, 24 at its opposite ends. Surfaces 22, 24 extend perpendicularly to the longitudinal axis Y of yoke 20. Yoke 20 is preferably composed of two elongate metal walls positioned with respect to one another in such a way as to release an internal volume. The two walls are kept parallel by a first and second flange-plate 22, 24 respectively placed at the ends of said walls. According to a particular embodiment, yoke 20 of parallelepipedic shape comprises at least two longitudinal surfaces open on the internal volume.

Magnetic circuit 12 further comprises a magnetic flux distribution shunt 26. The shunt 26 which can be saturated extends radially in a parallel direction to first flange-plate 22.

The electromagnetic actuator comprises a control circuit as described above. The control circuit comprises a first control coil 30A and a fixed second control coil 30B mounted coaxially on insulating sleeve 32 inside yoke 20. Said control coils 30A, 30B, are concentric and extend axially between shunt 26 and second flange-plate 24. Second control coil 30B is placed outside first control coil 30A.

Inside the internal volume of yoke 20 there is also positioned at least one permanent magnet 14 with axial magnetization. Said at least one magnet is placed between the walls of yoke 20. Permanent magnet 14 comprises two coplanar front surfaces of opposite polarities. A first surface is positioned facing shunt 26. A second surface is positioned against the internal wall of first flange-plate 22. The front surfaces are substantially perpendicular to the longitudinal axis Y of yoke 20.

The electromagnetic actuator comprises a plunger core 16 mounted with axial sliding in the direction of a longitudinal axis of the yoke 20. Movement of plunger core 16 takes place inside control coils 30A, 30B between two operating positions hereinafter called latched position PA and unlatched position PD.

A first axial air-gap e1 corresponds to the gap between shunt 26 and plunger core 16. This air-gap is maximum when the plunger core is in a second operating position called unlatched position PD as represented in FIG. 1. This air-gap is zero when the plunger core is in a first operating position called latched position PA as represented in FIG. 2.

The core is preferably composed of a cylinder made from magnetic or magnetizable material. A first radial surface of the cylinder is designed to be in contact with shunt 26 when the core is in latched position PA. A second radial surface of the cylinder is designed to be positioned close to the internal surface of second flange-plate 24 when the core is in unlatched position PD.

The internal surface of second flange-plate 24 comprises an internal sleeve 46 extending partially in an annular space arranged coaxially around plunger core 16. Plunger core 16 is then separated from said sleeve 46 by a second radial sliding air-gap e2 that remains uniform during movement of plunger core 16 in translation. In the latched position, sleeve 46 preferably covers plunger core 16 over an overlap distance L. Sleeve 46 is preferably of tubular shape and made from ferromagnetic material. It can form an integral part of second flange-plate 24 or be fixed to the latter by fixing means. Sliding air-gap e2 and overlap distance L between plunger core 16 and sleeve 46 are adjusted so that the reluctance of the whole of magnetic circuit 20 is as low as possible in the internal volume of first control coil 30A. The reluctance has to be lowest over the whole travel of plunger core 16 between the two operating positions.

Plunger core 16 in unlatched position PD is separated from the inside wall of second flange-plate 24 by a third axial air-gap e3 corresponding to the gap between second flange-plate 24 and plunger core 16. This air-gap e3 is minimum when plunger core is in unlatched position PD as represented in FIG. 1.

When the plunger core is in the latched position, the latter is kept stuck against shunt 26 by a magnetic attraction force FA due to a polarization flux $\phi U$ generated by said at least one permanent magnet 14. Plunger core 16 is designed to be urged to unlatched position PD by at least one return spring 36. The return force FR of return spring 36 tends to oppose the magnetic attraction force FA generated by permanent magnet 14. In the latched position, the intensity of magnetic attraction force FA is greater than the opposing return force of said at least one return spring 36 (FIGS. 5A, 5B, 5C, 5D).

The first front surface of said at least one permanent magnet 14 is separated from shunt 26 by a fourth air-gap e4. Said air-gap e4 is dimensioned such that it is as small as possible so as not to reduce the efficiency of magnet 14 but sufficient to prevent any mechanical shocks on the magnet or magnets. A shock absorber can be placed in the space formed by fourth air-gap e4. This shock absorber can comprise a gel. The object of this shock absorber is to reduce any repercussion of the shock between plunger core 16 and shunt 26 when said core moves from unlatched position PD to latched position PA.

Magnetic plunger core 16 is coupled to a non-magnetic actuating member 18 passing axially through an opening 17 made in first flange-plate 22. Non-magnetic actuating member 18 also passes through said at least one magnet 16. Plunger core 16 and actuating member 18 form the moving assembly of actuator 1.

According to a particular embodiment, moving assembly of actuator 1 is designed to control a vacuum cartridge of the current breaking device.

According to an embodiment of the invention as represented in FIGS. 1 and 2, the return spring is positioned outside yoke 20. It comprises a first surface bearing on a first external support such as a frame 100 and comprises a second surface bearing on a stop 19 placed on actuated member 18. In unlatched position PD, said stop 19 is pressing on a second external support. For example, the second external support can in particular form part of the external surface of first flange-plate 22. This longitudinal positioning of stop 19 on actuating member 18 enables the length of movement of the moving assembly of actuator 1, and more particularly the length of third air-gap e3 in unlatched position PD, to be controlled. Movement of stop 19 along actuating member 18 in fact enables the minimum size of this third air-gap e3 to be adjusted. Holding in latched position PA is guaranteed by said at least one return spring 36, 37.

First control coil 30A is designed to generate a first magnetic control flux $\phi C1$ in magnetic circuit 12. First magnetic control flux $\phi C1$ is designed to be added to polarization flux $\phi U$ of permanent magnet 14. First magnetic control flux $\phi C1$ therefore tends to oppose the action of said at least one return spring 36, 37 so as to move plunger core 16 from its unlatched position PD to its latched position PA.

Second control coil 30B is designed to generate a second magnetic control flux $\phi C2$ in magnetic circuit 12, which flux opposes polarization flux $\phi U$ of permanent magnet 14 so as to release plunger core 16 and to enable the latter to move from its latched position PA to its unlatched position PD. Movement of plunger core 16 from latched position PA to unlatched position PD takes place by the action of said at least one return spring 36, 37.

According to one embodiment of the invention as represented in FIG. 8, electromagnetic actuator 1 can be designed to control a current breaking device 22 in particular comprising a vacuum cartridge 2. First coil 30A generating first control flux $\phi C1$ is then designed to close the contacts of vacuum cartridge 2. Furthermore, second coil 30B generating second magnetic control flux $\phi C2$ is then designed for opening the contacts of vacuum cartridge 2. First coil 30A is then called closing coil and second coil 30B is called opening coil.

Due to the geometric configuration of magnetic circuit 12 and in particular due to the positioning of magnetic shunt 26 with respect to control coils 30A, 30B and of said at least one magnet 16, the flux created by control coils 30, 30A, 30B never flows through said at least one magnet 16. The risk of demagnetization of magnet 14 is thereby limited To move from an open position to a closed position of the contacts of vacuum cartridge 2, operation of electromagnetic actuating device 1 is as follows. As represented in FIG. 6A, two opposing forces are applied to plunger core 16. A return force FR applied by return spring 36 on plunger core 16 by means of a non-magnetic actuating member 18 tends to hold plunger core 16 in the unlatched position, the contacts being in the open position. Return force FR opposes a first magnetic closing force FA due to polarization flux ϕU of magnet 14. Magnetic closing force FA is of greater intensity than return force FR. As represented in FIG. 5B, first coil 30A is supplied with power to close the contacts. First coil 30A generates first control flux ϕC1. First control flux ϕC1 flows in the same direction as polarization flux ϕU of magnet 14. The first flux produces an electromagnetic closing force FFE. The two closing forces FA, FFE are added together and tend to move plunger core 16 from the unlatched position PD to the latched position PA. The intensity of electromagnetic closing force FFE undergoes a variation of exponential type. This variation depends directly on the geometry of the coil, in particular on its inductance and on the type of electric power supply used.

According to one embodiment of the invention, when plunger core 16 moves away from the unlatched position, the intensity of electromagnetic closing force FFE is greater than that of return force FR of return spring 36. This non-zero intensity (offset) of electromagnetic closing force FFE at the beginning of movement of plunger core 16 will enable an electromagnetic closing force FFE that is always greater than return force FR to be obtained in the course of movement of the plunger core.

The offset value is linked to the size of third air-gap e3, to magnet 14 and to first control flux ϕC1. As represented in FIG. 10, second flange-plate 24 diverts a part of first control flux ϕC1 from the main magnetic circuit. This diverted flux ϕCd creates an antagonistic force temporarily opposing electromagnetic closing force FFE. The time necessary to establish an efficient electromagnetic closing force FFE for movement of the plunger core is then longer. The dynamic beginning of movement of plunger core 16 is then delayed. This delay enables the electric current flowing in first coil 30A to reach a sufficient intensity to generate an efficient first control flux ϕC1.

As represented in FIG. 6B, when plunger core 16 starts to move, the potential energy stored by the electromagnetic actuator is then sufficient to guarantee an electromagnetic closing force FFE that will always be of greater intensity than return forces FR. This guarantees closing without any downtime and without plunger core 16 being slowed down.

According to a particular embodiment of the invention, during movement of plunger core 16 from its unlatched position PD to its latched position PA, electromagnetic closing force FFE will oppose a second force generated by a second return spring 37. This second spring 37 is designed to apply a contact pressure force in particular to keep the electric contacts of vacuum cartridge 2 closed. This second spring 37 will be compressed by the action of electromagnetic closing force FFE. It is at about two thirds of the closing travel of plunger core 16 that the combined return forces of first and second return springs 36, 37 will oppose electromagnetic closing force FFE. When plunger core 16 is in latched position PA as represented in FIG. 5D, power supply to the closing coil is interrupted. First magnetic closing force FA is then of greater intensity than the sum of return forces FR developed by first and second springs 36, 37. This magnetic latching of plunger core 16 in latched position PA can also be combined with mechanical latching.

To move from a closed position to an open position of the contacts of the vacuum cartridge 2, in other words from latched position PA to unlatched position PD of plunger core 16, operation of electromagnetic actuating device 1 is as follows. As represented in FIG. 6A, two opposing forces are applied on plunger core 16; a magnetic force FA due to polarization flux ϕU of magnet 14 and a return force FR resulting from the forces applied by said at least one return spring 36, 37. Magnetic force FA is then of greater intensity than return force FR.

Figure 6C:
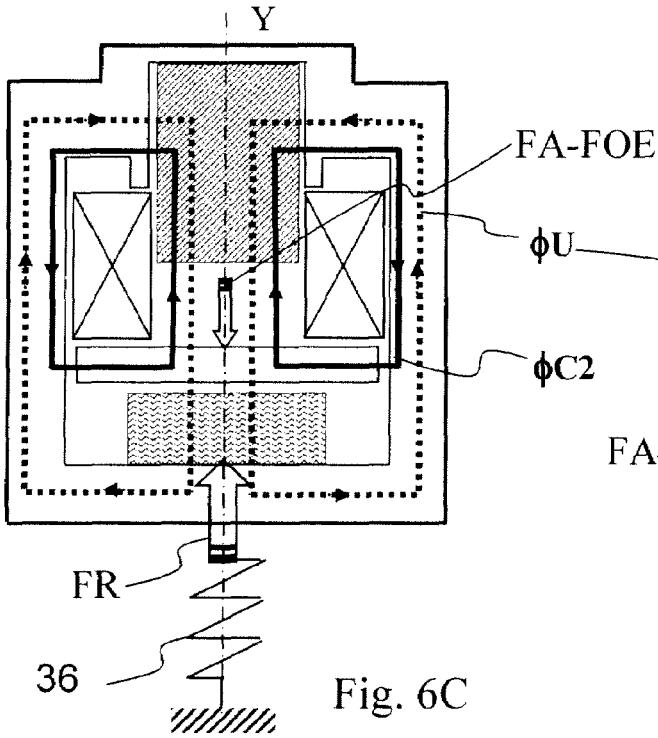
Figure 6D:
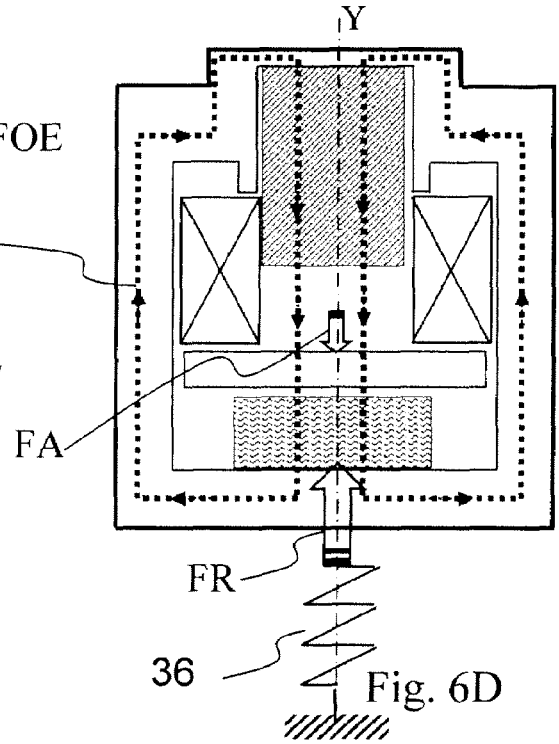

According to the embodiment represented in FIG. 6C, return force FR results from the sum of the forces applied jointly by first and second return springs 36, 37.

As represented in FIG. 6B, second coil 30B is supplied with power to generate second control flux ϕC2. Second control flux ϕC2 flows in an opposite direction to polarization flux ϕU of magnet 14. Second control flux ϕC2 produces an electromagnetic opening force FOE. Return force FR and electromagnetic opening force FOE are added together. The resulting opening force is then of greater intensity than magnetic latching force FA and tends to move plunger core 16 from its latched position PA to its unlatched position PD.

For example purposes, first closing coil 30A of the control circuit operates under 250 Volts DC with a current of 10 A, whereas second opening control coil 30B requires several hundred volts with 40 mA. The diameter of the wire of the two control coils 30A, 30B is different. Said coils in addition comprise a different number of turns.

First coil 30A requires a large amount of power for a given time to close the actuator. The supply time of first coil 30A is for example equal to about 150 ms. This power comes from the electric power supply system. Second coil 30B on the other hand only requires a small amount of power to open the actuator.

According to a particular embodiment, shunt 26 extending radially in a direction parallel to first flange-plate 22 26 is separated from yoke 20 by a fifth air-gap e5. At least one intermediate element 33 made from non-magnetic material can be placed in fifth air-gap e5. This intermediate element acting in particular as support for shunt 26 guarantees that fifth air-gap e5 is maintained. Shunt 26 can comprise a variable cross-section. Modifying the size of fifth air-gap e5 and/or the cross-section of shunt 26 enables the reluctance value of said shunt to be adjusted.

According to one embodiment of the invention, for ease of producing said at least one magnet 16, the electromagnetic actuator comprises at least two juxtaposed magnets 16. Said permanent magnets are respectively cut so as to leave passage hole 17 when they are juxtaposed. A centring part 19 is preferably placed in passage hole 17. Centring part 19 is salient from said at least one magnet 16 by the height of fourth air-gap e4. Said part is then in contact with shunt 26. Centring part 19 serves the purpose both of positioning the magnets, of absorbing a part of the mechanical shocks when plunger core 16 comes into contact with shunt 26, and finally also plays a part in guiding moving assembly 16, 18.

The invention claimed is:

1. A bistable electromagnetic actuator with magnetic latching for opening and closing commands of a vacuum cartridge of a current breaking device, comprising:

a magnetic circuit comprising a magnetic yoke in which a shunt extends perpendicularly to a longitudinal axis of said yoke, the shunt being positioned in parallel manner between first and second surfaces of said yoke, at least one permanent magnet with axial magnetization in the direction of the longitudinal axis of the yoke, said magnet being positioned between the first surface and the shunt, a plunger core mounted with axial sliding along the longitudinal axis of the yoke between a latched position and an unlatched position, at least one coil extending axially between the shunt and the second surface and being designed to generate:

a first magnetic control flux that is added to the polarization flux of said at least one permanent magnet to move the plunger core from the unlatched position to the latched position, at least one return spring opposing movement of said plunger core, a second magnetic control flux opposing the polarization flux of the permanent magnet and enabling movement of the plunger core from the latched position to the unlatched position by the action of said at least one return spring, wherein the second surface of the yoke comprises an internal sleeve extending partially around the plunger core, the latter being separated from said sleeve by a radial sliding air-gap remaining uniform during movement of the plunger core in translation, and, in the unlatched position, the plunger core is separated from the second surface of the yoke by a third air-gap, the shunt being separated from the plunger core by a first axial air-gap, the sleeve, in the latched position, covering the plunger core over an overlap distance.

2. The electromagnetic actuator according to claim 1, wherein said at least one permanent magnet is separated from the shunt by a fourth air-gap, the shunt being radially separated from the yoke by a fifth air-gap.

3. The electromagnetic actuator according to claim 1, wherein the magnetic plunger core is coupled to a non-magnetic actuating member extending along the longitudinal axis to pass through said at least one magnet and the first surface of the yoke.

4. The electromagnetic actuator according to claim 1, wherein the plunger core comprises a hole positioned in the radial surface in contact with the third air-gap, the hole passing through the plunger core from one side to the other in a direction parallel to the longitudinal axis.

5. The electromagnetic actuator according to claim 1, comprising a first coil designed to produce the first magnetic control flux and a second coil designed to produce the second magnetic control flux.

6. A control circuit for an electromagnetic actuator with a plunger core, a circuit comprising:

at least a first closing control coil designed to move the plunger core in a closing phase of the actuator, at least a second opening control coil designed to move the magnetic core in an opening phase of the actuator, said at least two control coils being coupled by mutual induction, a power supply circuit designed to supply power to said control coils in the closing and opening phases, comprising at least a first trigger capacitor, the power supply circuit comprising switching means designed:

to connect said at least first trigger capacitor in series with said second opening control coil, said at least first trigger capacitor being charged by an induced voltage at the terminals of said at least second opening control coil when a closing voltage is applied to the terminals of said at least first closing control coil, to connect said at least first trigger capacitor to the second opening control coil, said at least first trigger capacitor being discharged via said second opening control coil to develop an opening voltage at the terminals of said second opening control coil during the opening phase.

7. The control circuit according to claim 6, wherein the charging voltage of said at least first trigger capacitor is equal to the value of the induced voltage at the terminals of said at least second opening control coil when a closing voltage is applied to the terminals of said at least first closing control coil, the absolute value of the opening voltage being equal to the absolute value of the induced voltage.

8. The control circuit according to claim 6, comprising at least a second trigger capacitor, the power supply circuit comprising switching means designed:

to connect said at least first and second trigger capacitors in parallel during a closing phase, and to connect said at least first and second trigger capacitors in series during the opening phase, the opening voltage applied to said second control coil being equal to the sum of the voltages respectively induced at the terminals of the trigger capacitors.

9. The control circuit according to claim 8, wherein the absolute value of the opening voltage is equal to the sum of the charging voltages of said at least first and second trigger capacitors, the charging voltage of at least one trigger capacitor being equal to the value of the induced voltage at the terminals of said at least second opening control coil when a closing voltage is applied to the terminals of said at least first closing control coil.

10. The control circuit according to claim 6, wherein said at least first closing control coil comprises a smaller first number of turns than a second number of turns of said at least second opening control coil so that the induced voltage at the terminals of said at least second opening control coil is greater than the closing voltage applied to said at least first closing control coil.

11. An electromagnetic actuator, comprising a magnetic circuit having a magnetic yoke, at least one permanent magnet with axial magnetization in the direction of a longitudinal axis of the yoke and a plunger core mounted with axial sliding along the longitudinal axis between a latched position and an unlatched position, comprising a control circuit according to claim 6, the coils extending axially along the longitudinal axis of the yoke and being designed to generate:

a first magnetic control flux that is added to the polarization flux of said at least one permanent magnet to move the plunger core from the unlatched position to the latched position, the action of at least one return spring opposing movement of said plunger core, a second magnetic control flux opposing the polarization flux of the permanent magnet and enabling movement of the plunger core from the latched position to the unlatched position by the action of said at least one return spring.

12. The electromagnetic actuator according to claim 11, wherein the magnetic yoke comprises a shunt extending perpendicularly to a longitudinal axis of said yoke, the shunt being positioned in parallel manner between a first and second surface of said yoke, said at least one permanent magnet being positioned between the first surface and the shunt.

13. The electromagnetic actuator according to claim 11, wherein the second surface of the yoke comprises an internal sleeve extending partially around the plunger core, the latter being separated from said sleeve by a radial sliding air-gap remaining uniform during movement of the plunger core in translation, and, in the unlatched position, the plunger core is separated from the second surface of the yoke by a third air-gap, a volume between the shunt and the plunger core defining a first axial air-gap, the sleeve covering the plunger core over an overlap distance in the latched position.

14. The electromagnetic actuator according to claim 11, wherein said at least one permanent magnet is separated from the shunt by a fourth air-gap, the shunt being radially separated from the yoke by a fifth air-gap.

15. The electromagnetic actuator according to claim 11, wherein the magnetic plunger core is coupled to a non-magnetic actuating member extending along the longitudinal axis to pass through said at least one magnet and the first surface of the yoke.

* * * * *